US008740588B2

(12) United States Patent
Stones

(10) Patent No.: US 8,740,588 B2
(45) Date of Patent: Jun. 3, 2014

(54) MULTIPLE INLET VACUUM PUMPS

(75) Inventor: Ian David Stones, Burgess Hill (GB)

(73) Assignee: Edwards Limited (GB)

( * ) Notice: Subject to any disclaimer, the term of this patent is extended or adjusted under 35 U.S.C. 154(b) by 196 days.

(21) Appl. No.: 13/143,713

(22) PCT Filed: Jan. 21, 2010

(86) PCT No.: PCT/GB2010/050089

§ 371 (c)(1),
(2), (4) Date: Jul. 7, 2011

(87) PCT Pub. No.: WO2010/089579

PCT Pub. Date: Aug. 12, 2010

(65) Prior Publication Data

US 2011/0286864 A1 Nov. 24, 2011

(30) Foreign Application Priority Data

Feb. 6, 2009 (GB) ..... 0901872.2
Jan. 21, 2010 (WO) ..... PCT/GB2010/050089

(51) Int. Cl.
*F04B 23/04* (2006.01)
*F04D 19/04* (2006.01)

(52) U.S. Cl.
CPC ..... *F04D 19/04* (2013.01); *F04D 19/042* (2013.01); *F04D 19/044* (2013.01)
USPC ..... 417/423.4; 417/244

(58) Field of Classification Search
CPC ..... F04D 19/04; F04D 19/044; F04D 19/042; F04D 17/168
USPC ..... 417/244, 423.4
See application file for complete search history.

(56) References Cited

U.S. PATENT DOCUMENTS 5,585,548 A * 12/1996 Grosse Bley et al. ..... 73/40.7
5,733,104 A * 3/1998 Conrad et al. ..... 417/44.1
6,106,223 A * 8/2000 Leyshon ..... 415/90
6,200,107 B1 * 3/2001 Brewster ..... 417/251

(Continued)

FOREIGN PATENT DOCUMENTS

WO 0046508 A1 8/2000
WO 2005/033520 A1 4/2005
WO 2005033521 A1 4/2005
WO WO 2005033521 A1 * 4/2005 ..... F04D 19/04

OTHER PUBLICATIONS

Translation of the First Office Action mailed Jun. 4, 2013 from the State Intellectual Property Office, P.R. China in corresponding CN Application No. 201080006756.7, 11 pgs.

(Continued)

*Primary Examiner* — Peter J Bertheaud
*Assistant Examiner* — Dominick L Plakkoottam
(74) *Attorney, Agent, or Firm* — Shumaker & Sieffert, P.A.

(57) ABSTRACT

First and second pump stages provide a flow-path from an inlet to the outlet (30), the flow-path being arranged so that molecules entering the first inlet (26) pass to the outlet through the first (120) and second (122) pump stage, and so that molecules entering the second inlet (28) pass to the outlet through an inter-stage volume (121) and second pump stage (122); wherein the first (120) and second (122) pump stages each comprise a turbo-molecular sub-stage (120*a*, 122*a*) and a molecular drag sub-stage (120*b*, 122*b*).

18 Claims, 3 Drawing Sheets

(56) References Cited

U.S. PATENT DOCUMENTS

| | | | | |
|---|---|---|---|---|
| 6,887,032 | B2 * | 5/2005 | Favre-Felix et al. | 415/90 |
| 7,762,763 | B2 * | 7/2010 | Stones | 415/90 |
| 7,866,940 | B2 * | 1/2011 | Stones et al. | 415/55.6 |
| 8,105,013 | B2 * | 1/2012 | Stones | 415/116 |
| 8,235,678 | B2 * | 8/2012 | Stones | 417/203 |
| 8,393,854 | B2 * | 3/2013 | Stones et al. | 415/90 |
| 2003/0086784 | A1 * | 5/2003 | Stuart | 415/90 |
| 2007/0020116 | A1 * | 1/2007 | Stones | 417/201 |
| 2007/0031263 | A1 * | 2/2007 | Stones et al. | 417/199.2 |
| 2007/0081889 | A1 | 4/2007 | Engländer | |
| 2007/0116555 | A1 * | 5/2007 | Stones et al. | 415/90 |
| 2008/0008602 | A1 * | 1/2008 | Pozivil et al. | 417/243 |
| 2008/0063541 | A1 * | 3/2008 | Stones | 417/250 |
| 2008/0138219 | A1 * | 6/2008 | Stones et al. | 417/423.4 |
| 2008/0145205 | A1 * | 6/2008 | Stones | 415/143 |
| 2008/0193303 | A1 * | 8/2008 | Stones | 417/251 |
| 2011/0200423 | A1 * | 8/2011 | Stones et al. | 415/1 |
| 2012/0168621 | A1 * | 7/2012 | Stones | 250/287 |

OTHER PUBLICATIONS

Invitation to Respond to Written Opinion mailed Sep. 11, 2012 in corresponding SG Application No. 201104817-0, 5 pgs.

Response filed Mar. 8, 2012 to EP Communication Pursuant to Rules 161(1) and 162 EPC mailed Sep. 5, 2011 in corresponding EP Application No. 10704403.4-2315, 4 pgs.

EP Communication Pursuant to Rules 161(1) and 162 EPC mailed Sep. 5, 2011 in corresponding EP Application No. 10704403.4-2315, 2 pgs.

* cited by examiner

MULTIPLE INLET VACUUM PUMPS

TECHNICAL FIELD

The present invention relates to multiple inlet vacuum pumps.

BACKGROUND

Vacuum pumps having multiple inlets are well known in the art. An example of such a pump, configured as a turbo-molecular pump, is described in U.S. Pat. No. 6,709,228. These types of pumps are suitable for differential pumping multiple chambers, amongst other applications.

In a differentially pumped mass spectrometer system a sample and carrier gas are introduced to a mass analyser for analysis. Typically, the sample is ionised and the carrier gas has neutral charge. An example of such a mass spectrometer is shown in FIG. 1. With reference to FIG. 1, in such a system there exists a high vacuum chamber 10 immediately following first and second evacuated interface chambers 12, 14. The first interface chamber 12 is the highest-pressure chamber in the evacuated spectrometer system and may contain an orifice or capillary through which sample ions are drawn from an ion source into the first interface chamber 12, and ion optics for guiding ions from the ion source into the second interface chamber 14. The second, middle chamber 14 may include additional ion optics for guiding ions from the first interface chamber 12 into the high vacuum chamber 10. In this example, in use, the first interface chamber is at a pressure of around 1 mbar, the second interface chamber is at a pressure of around $10^{-3}$ mbar, and the high vacuum chamber is at a pressure of around $10^{-5}$ mbar. The unionised carrier gas is removed from the mass spectrometer chambers by the vacuum pump Both the high vacuum chamber 10 and second interface chamber 14 are evacuated by means of a compound vacuum pump 16 having multiple inlets. In this example, the vacuum pump has two pumping sections in the form of two sets 18, 20 of turbo-molecular stages, and a third pumping section in the form of a Holweck drag mechanism 22; an alternative form of drag mechanism, such as a Siegbahn or Gaede mechanism, could be used instead. Each set 18, 20 of turbo-molecular stages comprises a number of rotor 19*a*, 21*a* and stator 19*b*, 21*b* blade pairs (three are shown in FIG. 1, although any suitable number could be provided) of known angled construction. The Holweck mechanism 22 includes a number of rotating cylinders 23*a* (two are shown in FIG. 1 although any suitable number could be provided) and corresponding annular stators 23*b* and helical channels in a manner known per se.

In this example, a first pump inlet 24 is connected to the high vacuum chamber 10, and fluid (or gas molecules) pumped through the inlet 24 passes through both sets 18, 20 of turbo-molecular stages in sequence and the Holweck mechanism 22 and exits the pump via outlet 30. A second pump inlet 26 is connected to the second interface chamber 14, and fluid pumped through the inlet 26 passes through set 20 of turbo-molecular stages and the Holweck mechanism 22 and exits the pump via outlet 30. The first interface chamber 12 is connected to a backing pump 32, which also pumps fluid from the outlet 30 of the compound vacuum pump 16. As fluid entering each pump inlet passes through a respective different number of stages before exiting from the pump, the pump 16 is able to provide the required vacuum levels in the chambers 10, 14.

FIG. 2 shows a known alternative compound pumping system suitable for use with a differentially pumped mass spectrometer. In this instance, the mass spectrometer comprises four chambers which are pumped to different pressures; a third chamber 13 is located between the first and second interface chambers 12 and 14 respectively. In this example, the vacuum pump has two pumping sections in the form of two sets 18, 20 of turbo-molecular stages, and a third pumping section in the form of a Siegbahn molecular drag mechanism 22; an alternative form of molecular drag mechanism, such as a Holweck or Gaede mechanism, could be used instead. A third pump inlet 28 connects the third chamber and fluid pumped through the inlet 28 passes through the Siegbahn mechanism or pump inter-stage 22 and exits the pump via outlet 30. Typically, the third chamber is pumped to a pressure in the transitional flow regime, between viscous and molecular flow regimes. The transitional flow regime is generally understood to be between 0.01 and 0.1 mbar.

In some such applications, a Holweck mechanism such as that illustrated in FIG. 1 typically provides a backing pressure to the second pumping section 20 of around 0.01 mbar to 0.1 mbar. The use of turbo-molecular stages for a pumping section having such a relatively high backing pressure to produce an inlet pressure of above $10^{-3}$ mbar may cause excessive heat generation within the pump and severe performance loss, and may even be detrimental to the pump's reliability. WO2006/090103 describes a compound pump comprising a helical rotor. In such a pump, during use the inlet of the helix of the helical rotor behaves like a rotor of a turbo-molecular stage, and thus provides a pumping action through both axial and radial interactions.

In some applications there is a general requirement towards higher mass throughput (gas flows) in mass spectrometer systems, so as to improve their performance. In order to increase system performance, it may be desirable to increase the mass flow rate of the sample and a carrier gas from the source into the first chamber 12, whilst maintaining a low partial pressure of neutral carrier gas in the high vacuum chamber 10. In this case, additional pumping is required at one of the intermediate chambers 13, 14 to remove the carrier gas before it reaches the high vacuum chamber 10. This can be achieved by a number of methods including the addition of more pumping stages and chambers (as shown between FIGS. 1 & 2), increasing the capacity or pumping speed of the pumping stages or increasing the conductance of the pumping ports.

For the pumps illustrated in FIG. 1 or 2, higher mass throughput could be achieved by increasing the capacity of the compound vacuum pump 16 by increasing the diameter of the rotors 21*a* and stators 21*b* of set 20. For example, in order to double the capacity of the pump 16 at the interstage between sections 20 and 18, the area of the rotors 21*a* and stators 21*b* would be required to double in size. Any molecular drag stage may also require an increase in capacity to efficiently pump molecules which have passed through the up-stream turbo-molecular stage(s). The additional volume occupied by a molecular-drag stage having increased capacity would be substantial given the relatively poor pumping capacity of such pump stages compared to turbo-molecular pump configurations. This would cause an increase in the overall size of the pump 16, and thus the overall size of the mass spectrometer system. Furthermore, increasing the pumping speed typically results in a significant increase in the pump's power consumption in non-molecular flow conditions.

SUMMARY

The present invention aims to ameliorate the problems associated with multiple inlet vacuum pumps described above. What is more, it is an aim of the present invention to provide a multiple inlet vacuum pump with increased performance, particularly (but not exclusively) in the transitional pressure regime, without a substantial impact on the pump's power consumption.

To achieve this aim, the present invention provides a compound vacuum pump having multiple inlets as described in the prior art, characterised in that the pump further comprises a turbo-molecular sub-stage disposed on the final pump stage prior to an outlet, and molecular drag sub-stage disposed on a turbo-molecular stage prior to the final pump stage.

More precisely, there is provided a multiple inlet vacuum pump, comprising; a first and second pump stage having an inter-stage volume therebetween; a first and second inlet, each being arranged to receive gas molecules from a chamber; and an outlet arranged to exhaust gas molecules from the pump; wherein the first and second pump stages provide a flow-path from an inlet to the outlet, the flow-path being arranged so that molecules entering the first inlet pass to the outlet through at least a portion of the first pump stage, the inter-stage volume and second pump stage, and so that molecules entering the second inlet pass to the outlet through at least a portion of the inter-stage volume and second pump stage; characterised in that the first and second pump stages each comprise a turbo-molecular sub-stage and a molecular drag sub-stage. Thus, the turbo-molecular sub-stages act to reduce the backing pressure and improve the gas-throughput for each molecular drag sub-stage. Also, each molecular drag sub-stage acts as a backing stage to the turbo-molecular pump sub-stage.

Preferably, the molecular drag sub-stages are each arranged downstream of the turbo-molecular sub-stages. Thus, during use the high pumping speed or capacity of the turbo-molecular sub-stage, relative to the molecular drag sub-stage, acts to improve the gas throughput of the pump.

Preferably, the first and second pump stage are interposed by an inter-stage volume, and during use, the pump is operable so that the pressure in the inter-stage volume is typically between 0.001 mbar and 0.1 mbar, or between 0.01 mbar and 0.1 mbar. As a result, the pump operates efficiently.

Preferably, a rotor component of each of the first and second pump stages is disposed on a rotor shaft arranged to be driven by a motor. Thus, a single motor can be arranged to drive the pumping components.

Preferably, a third pump stage is arranged upstream of the first pump stage, and a third inlet is arranged to receive gas molecules from a chamber into the third pump stage. Additionally, the third pump stage can comprise only turbo-molecular sub-stages. Thus, the third pumping stage comprises solely turbo-molecular components and can be operable to evacuate the third inlet to a pressure lower than the first or second inlet. Furthermore, a rotor component of the third pump stage can be disposed on the rotor shaft so that all the rotor components can be driven by the same motor. Thus, additional pumping capability can be achieved. Yet further, a flow path through the third pump stage is arranged so that molecules entering the third inlet pass to the outlet through the third, first and second pump stage, respectively. Thus, high vacuum pressures are achievable at the third inlet.

Preferably, the molecular drag sub-stage of the first or second pump stage is configured as any one of a Seigbahn, Holweck, and Gaede molecular drag sub-stage, or combination thereof.

BRIEF DESCRIPTION OF THE DRAWINGS

An embodiment of the present invention is now described, by way of example, with reference to accompanying drawings, of which.

DETAILED DESCRIPTION

Figure 3:
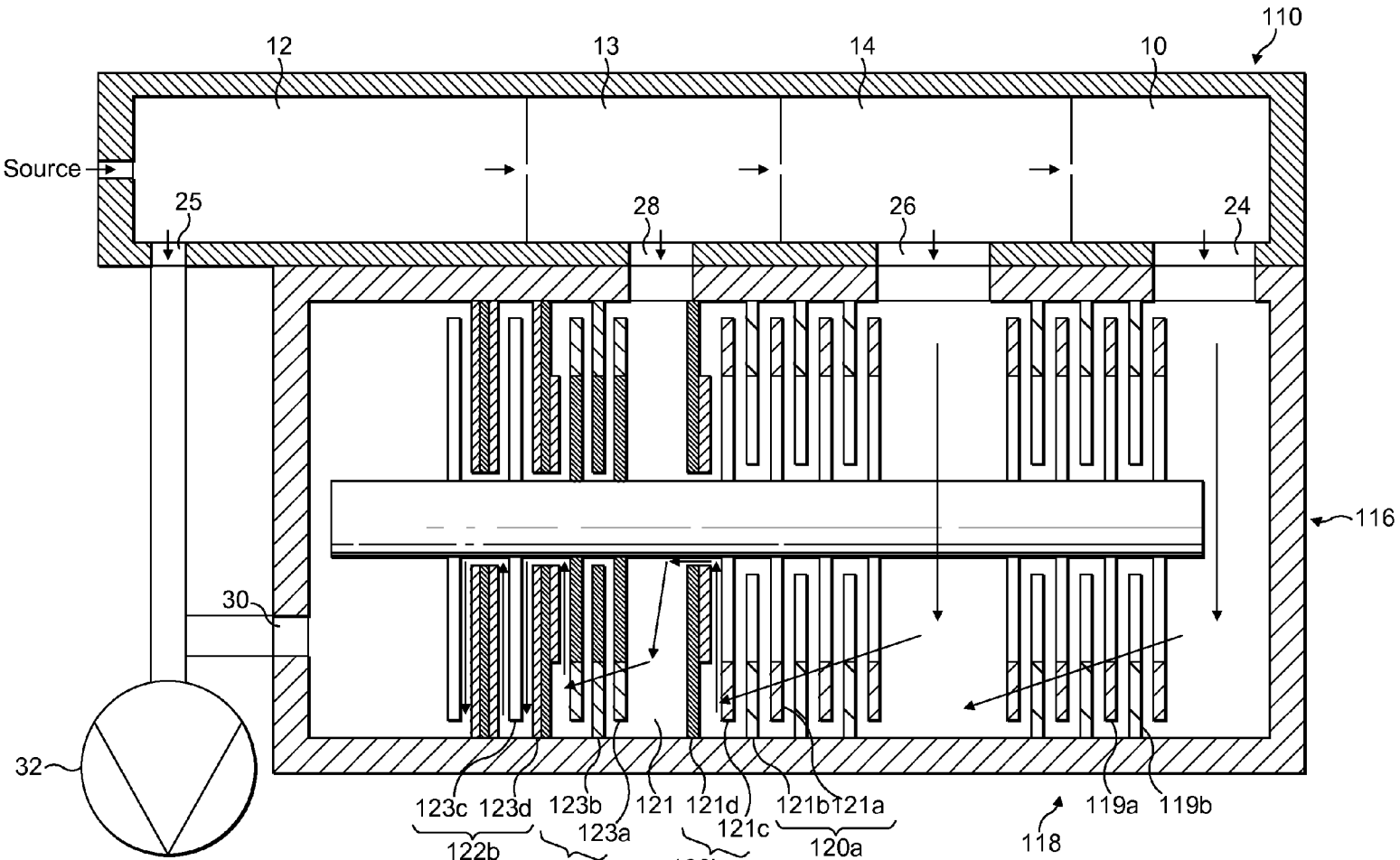
FIG. 3 is a schematic diagram of a multiple inlet compound vacuum pump embodying the present invention.

An embodiment of the present invention is shown in FIG. 3, where features of the systems described above have been given the same reference number indicators. The pump 116 is coupled to a differentially pumped mass spectrometer 110 comprising chambers 12, 13, 14 and 10, where the chambers are arranged to be pumped to different vacuum levels, as previously described. Each chamber shown has an outlet 25, 28, 26 and 24 respectively. A backing pump 32 is arranged to evacuate the first chamber 12 and to provide a backing pressure to the outlet 30 of the pump 116.

The pump comprises three pumping inter-stages, 118, 120 and 122, respectively. Thus, gas molecules evacuated from the final high vacuum chamber 10 of the mass spectrometer pass through all the pump inter-stages to the pump's outlet 30; gas molecules from the second chamber 14 pass through the second and third stages (120 and 122 respectively); and gas molecules from the third chamber 13 pass through the third stage 122 only.

The first pump stage 118 comprises a conventional turbo-molecular stage, made up of a number of rotor blades 119*a* and stator blades 119*b*. Typically, the required vacuum pressure in the final chamber 10 of the mass spectrometer is in the region of $10^{-5}$ mbar. Thus, a turbo-molecular pump of this configuration is readily able to achieve these pressures in an efficient manner.

The second pump stage 120 comprises a turbo-molecular sub-stage 120A and a molecular drag sub-stage 1208. The turbo-molecular sub-stage comprises conventional rotor blades 121*a* and stator blades 121*b*. The molecular drag sub-stage comprises a rotating disc 121*c* and a stator component 121*d* comprising spiral grooves. In the embodiment shown in FIG. 3, the molecular drag stage is configured as a Seigbahn molecular drag because this configuration offers a relatively compact topology suitable for the mass spectrometer application. However, the present invention is not limited to Seigbahn molecular drag configurations and any molecular drag pump configuration could be used.

The third pump stage 122 also comprises a turbo-molecular sub-stage 122A and a molecular drag sub-stage 1228. The turbo-molecular sub-stage comprises conventional rotor blades 123*a* and stator blades 123*b*. The molecular drag sub-stage comprises a rotating disc 123*c* and a stator component 123*d* comprising spiral grooves. In the embodiment shown in FIG. 3, the molecular drag stage in the third pump stage is also configured as a Seigbahn molecular drag because this configuration offers a relatively compact topology suitable for the mass spectrometer application. The configuration shown in figure comprises a Seigbahn stage comprising three rotor components (consisting of rotating discs comprising smooth surfaces) and four stator components (consisting of two discs each having spiral grooves on both sides of the disc). Of course, the present invention is not limited to Seigbahn molecular drag configurations and any molecular drag pump configuration could be used.

This pump configuration provides a molecular drag backing stage to the second pump stage and a turbo-molecular booster stage to the third pump stage. By this configuration, this embodiment of the present invention aims to provide increased pump inter-stage speeds for a differentially pumped vacuum systems whereby the inter-stage is operational in the transitional pressure regime (typically 0.01-0.1 mbar). At the same time, power consumption is maintained at a relatively low level.

Figure 1:
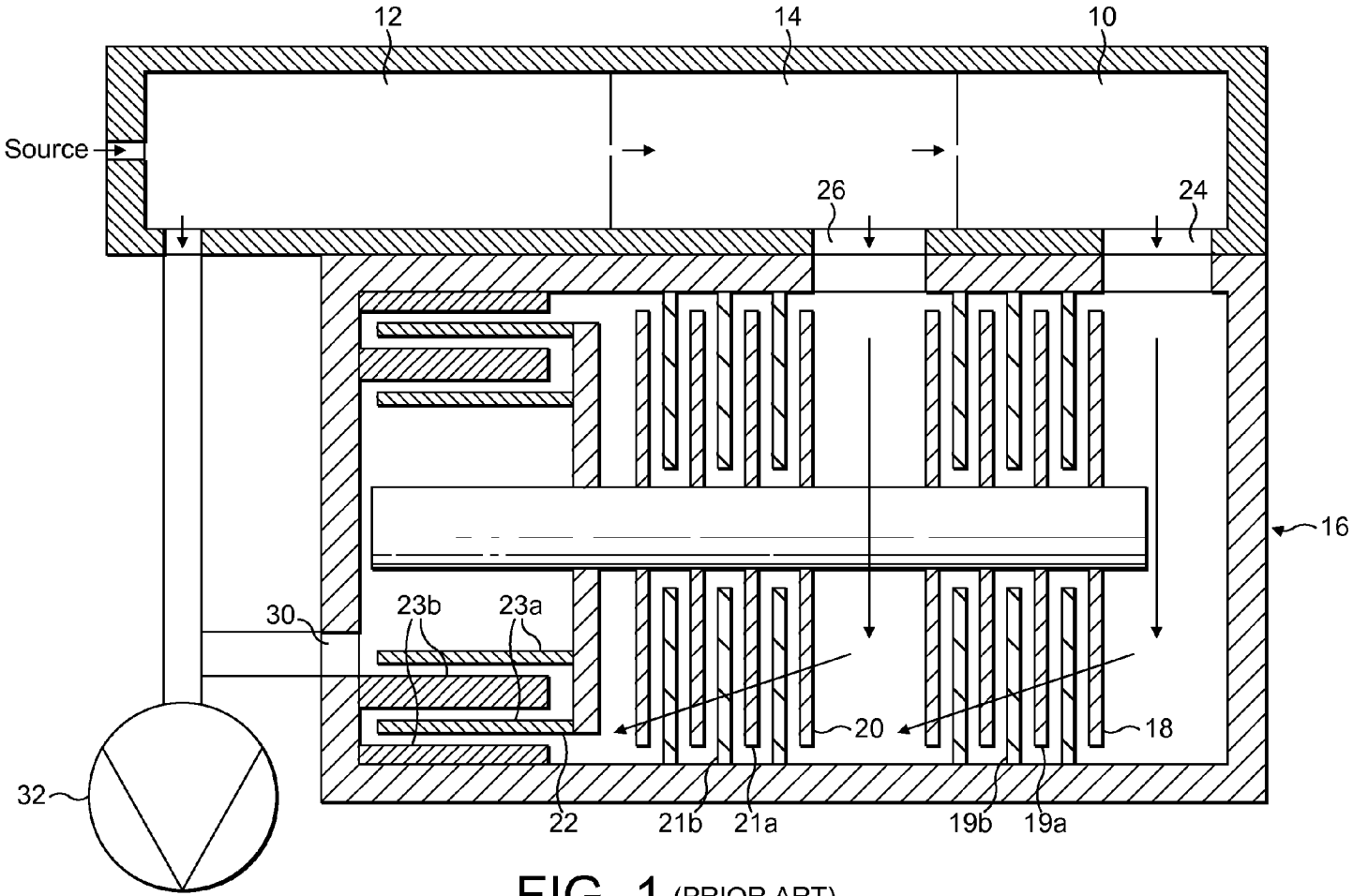
FIG. 1 (PRIOR ART)
FIG. 1 is a schematic diagram of a known multiple inlet compound vacuum pump.
Figure 2:
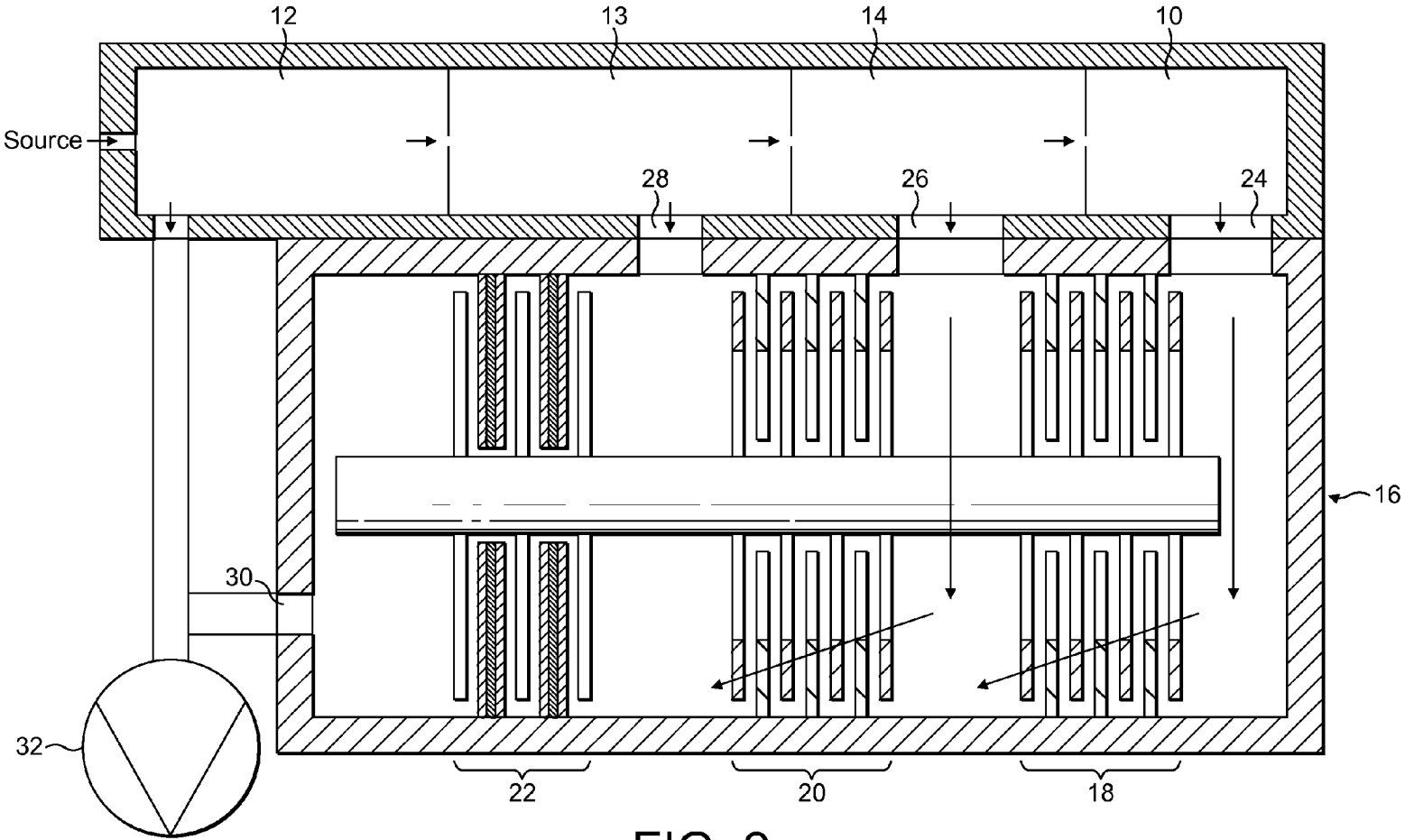
FIG. 2 is a schematic diagram of another known multiple inlet compound vacuum pump.

Molecular drag pump mechanisms are known to consume relatively low power compared to other mechanisms such as turbo-molecular pumps. However, these mechanisms have relatively low pumping speeds in comparison to other mechanisms such as turbo-molecular blades. By configuring a pump in the manner described above, we have been able to increase the inter-stage pumping speeds. This is achieved by introducing a number of turbo-molecular blades 123*a* upstream of the molecular drag stage. According to our computational modelling results, based on discrete stage experimental data, this configuration may enable port 28 to offer twice the amount of pumping speed at 0.1 mbar compared to the configuration shown in FIG. 2. An even higher performance increase may be realised at lower pressures.

When operating in the transitional flow regime, the power consumption associated with the turbo-molecular pump stages can become excessive due to relatively high operational pressures. To help prevent this, a molecular drag sub-stage 120B is provided between the inter-stage port 28 and upstream turbo-molecular stages 120A and 118. Furthermore, by providing a turbo-molecular pumping sub-stage 122A downstream of the inter-stage port 28, the pumping speed offered by the drag stages can be improved. As a result, the flow rate through the pump can be increased.

The design of the turbo-molecular sub-stage 122A is carefully selected to offer maximum performance and minimum power in the transitional pumping regime. This will include consideration of the blade length, angle and number of blades as well as the axial length of the blades. All of these factors can be optimised for the specific pumping requirements of a system.

Also, the provision of the molecular drag sub-stage 120B upstream of the inter-stage port 28 acts to reduce the power consumption of the upstream turbo-molecular stages.

Thus, by combining the layout described with the topological advantages of the Siegbahn Mechanism it is possible to provide a compact solution which offers enhanced pumping speeds with minimised increase to power consumption.

The embodiment describe above is an example of how the present invention can be implemented. The skilled person will consider alternatives to the described embodiment without departing from the scope of the inventive concept. For example, different configurations of molecular drag stages can be used, as appropriate for the flow rate requirements of the pump's application. For instance, the final molecular drag stage can be configured to exhaust to atmospheric pressure negating the need for a backing pump. The inter-stage volume can be minimised by using various inlet configurations to reduce the overall length of the pump. Although the present invention has been described with reference to use on differentially pumped mass spectrometer systems, it is not limited to such application and embodiments of the present invention can find use elsewhere.

The invention claimed is:

1. A multiple inlet vacuum pump comprising a first pump stage comprising a first turbo-molecular sub-stage and a first molecular drag sub-stage;

a second pump stage including a second turbo-molecular sub-stage and a second molecular drag sub-stage;

an inter-stage volume interposed between the first pump stage and the second pump stage;

a first inlet arranged to receive gas molecules from a first chamber;

a second inlet arranged to receive gas molecules from a second chamber; and an outlet arranged to exhaust gas molecules from the multiple inlet vacuum pump, wherein the first and second pump stages provide a flow-path from the first inlet to the outlet, the flow-path being arranged so that molecules entering the first inlet pass to the outlet through the first and second pump stages, and so that molecules entering the second inlet pass to the outlet through the inter-stage volume and the second pump stage.

2. The multiple inlet vacuum pump of claim 1, wherein the multiple inlet vacuum pump is operable so that the pressure in the inter-stage volume is between 0.001 mbar and 1 mbar.

3. The multiple inlet vacuum pump of claim 1 or 2, wherein the first molecular drag sub-stage is arranged downstream of the first turbo-molecular sub-stage, and wherein the second molecular drag sub-stage is arranged downstream of the second turbo-molecular sub-stage.

4. The multiple inlet vacuum pump of claim 1, wherein a rotor component of each of the first and second pump stages is disposed on a rotor shaft.

5. The multiple inlet vacuum pump of claim 1, further comprising a third pump stage arranged upstream of the first pump stage and a third inlet arranged to receive gas molecules from a third chamber into the third pump stage.

6. The multiple inlet vacuum pump of claim 5, wherein the third pump stage comprises only turbo-molecular sub-stages.

7. The multiple inlet vacuum pump of claim 4, further comprising a third pump stage arranged upstream of the first pump stage and a third inlet arranged to receive gas molecules from a third chamber into the third pump stage, wherein a rotor component of the third pump stage is disposed on the rotor shaft.

8. The multiple inlet vacuum pump of claim 5, wherein a flow path through the third pump stage is arranged so that molecules entering the third inlet pass to the outlet through the third pump stage, the first pump stage, and the second pump stage.

9. The multiple inlet vacuum pump of claim 1, wherein at least one of the first molecular drag sub-stage or the second molecular drag sub-stage is configured as at least one of a Siegbahn, Holweck, or Gaede molecular drag sub-stage.

10. The multiple inlet vacuum pump of claim 1, further comprising a mass spectrometer, wherein the mass spectrometer comprises the first chamber and the second chamber.

11. A method comprising:

attaching a first chamber of a mass spectrometer in fluidic communication with a first inlet of a multiple inlet vacuum pump;

attaching a second chamber of the mass spectrometer in fluidic communication with a second inlet of the multiple inlet vacuum pump, wherein the multiple inlet vacuum pump comprises a first pump stage comprising a first turbo-molecular sub-stage and a first molecular drag sub-stage, a second pump stage including a second turbo-molecular sub-stage and a second molecular drag sub-stage, an inter-stage volume interposed between the first pump stage and the second pump stage, the first inlet, the second inlet, and an outlet arranged to exhaust gas molecules from the multiple inlet vacuum pump,. wherein the first and second pump stages provide a flow-path from the first inlet to the outlet, the flow-path being arranged so that molecules entering the first inlet pass to the outlet through the first and second pump stages, and so that molecules entering the second inlet pass to the outlet through the inter-stage volume and the second pump stage.

12. The method of claim 11, further comprising operating the multiple inlet vacuum pump so that the pressure in the inter-stage volume is between 0.001 mbar and 1 mbar.

13. The method of claim 11, wherein the first molecular drag sub-stage is arranged downstream of the first turbo-molecular sub-stage, and wherein the second molecular drag sub-stage is arranged downstream of the second turbo-molecular sub-stage.

14. The method of claim 11, wherein a rotor component of each of the first and second pump stages is disposed on a rotor shaft.

15. The method of claim 11, further comprising a third pump stage arranged upstream of the first pump stage and a third inlet arranged to receive gas molecules from a third chamber of the mass spectrometer into the third pump stage.

16. The method of claim 15, wherein the third pump stage comprises only turbo-molecular sub-stages.

17. The method of claim 15, wherein a flow path through the third pump stage is arranged so that molecules entering the third inlet pass to the outlet through the third pump stage, the first pump stage, and the second pump stage.

18. The method of claim 11, wherein at least one of the first molecular drag sub-stage or the second molecular drag sub-stage is configured as at least one of a Siegbahn, Holweck, or Gaede molecular drag sub-stage.

* * * * *